US007626603B2

(12) United States Patent
Lu et al.

(10) Patent No.: US 7,626,603 B2
(45) Date of Patent: Dec. 1, 2009

(54) THERMAL TRANSFER DEVICE AND METHOD FOR FORMING A DISPLAY DEVICE USING THE SAME

(75) Inventors: Chih-Chiang Lu, Hsinchu (TW); Yan-Rung Lin, Hsinchu (TW)

(73) Assignee: Industrial Technology Research Institute, Hsin Chu Hsien (TW)

( * ) Notice: Subject to any disclaimer, the term of this patent is extended or adjusted under 35 U.S.C. 154(b) by 460 days.

(21) Appl. No.: 11/591,491

(22) Filed: Nov. 2, 2006

(65) Prior Publication Data

US 2008/0124646 A1 May 29, 2008

(51) Int. Cl.
*B41J 2/38* (2006.01)

(52) U.S. Cl. ..... 347/187

(58) Field of Classification Search ..... 347/175, 347/171–174, 213; 430/138, 1, 151, 157, 430/263; 428/323; 101/488
See application file for complete search history.

(56) References Cited

U.S. PATENT DOCUMENTS

| | | | | |
|---|---|---|---|---|
| 4,631,577 | A | 12/1986 | Yamanishi | |
| 5,216,438 | A | 6/1993 | Nakao et al. | |
| 6,031,586 | A | 2/2000 | Fassler et al. | |
| 6,228,543 | B1 | 5/2001 | Mizuno et al. | |
| 6,228,555 | B1 | 5/2001 | Hoffend, Jr. et al. | |
| 6,291,126 | B2 | 9/2001 | Wolk et al. | |
| 6,582,877 | B2 | 6/2003 | Chang et al. | |
| 2004/0214093 | A1 * | 10/2004 | Miyazaki | 430/1 |

FOREIGN PATENT DOCUMENTS

| | | |
|---|---|---|
| JP | 63-60788 | 3/1988 |
| JP | 6-219052 | 8/1994 |

* cited by examiner

*Primary Examiner*—K. Feggins
(74) *Attorney, Agent, or Firm*—Birch, Stewart, Kolasch & Birch, LLP

(57) ABSTRACT

A thermal transfer device used for forming a display device includes a donor layer capable of modulating light by application of external energy, a print heat for conducting thermal energy to the donor layer, at least one donor element formed by the donor layer absorbing the thermal energy and a substrate receiving the at least one donor element forming at least one light modulation unit thereon. First pixel electrodes can be first formed on a surface of the substrate contacting the light modulation units and then second pixel electrodes are formed on the light modulation units. A basic display unit therefore can be made.

20 Claims, 2 Drawing Sheets

THERMAL TRANSFER DEVICE AND METHOD FOR FORMING A DISPLAY DEVICE USING THE SAME

BACKGROUND OF THE INVENTION

1. Field of the Invention

The present invention relates to a thermal transfer device, and more particularly to a thermal transfer device used for forming a light modulator or a display device.

2. Description of the Related Art

Cost issue has become more and more crucial in the development of display devices, especially under driven by the application of LCD televisions. Inkjet printing has been developed for the sake of cost saving. Not only saving the material, but also it can directly pattern desired areas for particular purposes. However, the precise droplet control is seriously concerned in inkjet printing. Controlling the printing direction of the droplets flowing through the air strictly challenges the print head and the recipe. Thermal transfer is another technology similar to the printing technology. If the material having been transferred is well controlled, it is worthy to develop the thermal transfer technology in the application of the display devices.

In the known thermal transfer technology, U.S. Pat. No. 5,216,438 provides a direct color thermal printing method for optically and thermally recording a full-color image on a thermosensitive recording medium. FIG. 1 shows an example of the thermosensitive recording medium 10 in which a thermosensitive recording layer 12, which is developed in a cyan color, a thermosensitive recording layer 13, which is developed in a magenta color, a thermosensitive recording layer 14, which is developed in a yellow color, and a protective layer 15 are laminated on a supporting material 11 in the order from the bottom. The thermosensitive recording layer 12 develops cyan when a predetermined amount of heat energy per unit area is applied thereto. The thermosensitive recording layer 13 contains a diazonium salt compound having a maximum absorption factor at a first specific wavelength and a coupler which acts upon the diazonium salt compound and develops magenta when it is heated. The thermosensitive recording layer 13 loses its capacity to develop color when it is exposed to the ray with the first specific wavelength, because the diazonium salt compound is photo-chemically decomposed by the ray. The thermosensitive recording layer 14 contains a second diazonium salt compound having a maximum absorption factor at a second specific wavelength and a coupler which acts upon the second diazonium salt compound and develops yellow when it is heated. The thermosensitive recording layer 14 is also optically fixed and loses its color developability when it is exposed to the ray of the second specific wavelength. A cyan image is recorded in the thermosensitive recording layer 12 by applying appropriate heat energy thereto. Making use of this heat energy, the thermosensitive recording layers 13 and 14 having optically recorded images are thermally developed, whereby the diazonium salt compounds remaining in these layers couple with the couplers and thus develop magenta and yellow colors. The recording medium 10 thus has a full-color image thereon.

U.S. Pat. No. 6,228,555 disclosed a thermal mass transfer donor element as shown in FIG. 2, in which the donor element 106 includes a donor substrate 110, a light-to-heat conversion (LTHC) layer 112, a thermal transfer layer 114, and an underlayer 118 disposed between the donor substrate 110 and the LTHC layer 112. By placing the thermal transfer layer 114 of the donor element 106 adjacent to a receptor substrate (not shown) and irradiating the donor element 106 with image radiation that can be absorbed by LTHC layer 12 and converted into heat, material can be transferred from the thermal transfer layer 114 to the receptor substrate to form patterns of the transferred material thereon.

U.S. Pat. No. 6,031,586 disclosed a printing apparatus for radiation thermal transfer of colorant from a donor to a receiver, including a flash tube for emitting high intensity radiation, a polarizer for receiving high intensity radiation from the flash tube and polarizing such radiation, and liquid crystal cells disposed to receive polarized radiation from the polarizer. Electrodes modulate the liquid crystal cells so that they change polarization of the radiation passing through them. A second polarizer receives radiation from the liquid crystal cells and is arranged to pass different intensities of radiation depending on their polarization. The colorant donor and the receiver are positioned in colorant transfer relationship with the second polarizer at a colorant position so that radiation which passes through the second polarizer illuminates the colorant donor so that colorant is transferred to the receiver.

SUMMARY OF THE INVENTION

One objective of the present invention is to provide a thermal transfer device used for forming a light modulator or a display device, in which a donor layer capable of modulating light by application of external energy is employed.

Another objective of the present invention is to provide a method for thermal mass transfer forming a display device by using the thermal transfer device of the present invention to transfer donor elements onto a display substrate, in which the donor elements are functioned as light modulators under application of the external energy.

According to the above objectives, the present invention provides a thermal transfer device, which comprises a donor layer capable of modulating light by application of external energy, a print head for conducting thermal energy to the donor layer, at least one donor element formed by the donor layer absorbing the thermal energy, and a substrate receiving the at least one donor element forming at least one light modulation unit thereon.

It is preferable that the external energy is provided by application of electric field, electromagnetic rays or heat onto the donor elements received on the substrate such that the donor elements become light modulators.

In another aspect, the present invention provides a method for thermal mass transfer forming a display device, which comprises providing a donor layer over a first substrate; providing thermal energy to at least one defined area of the donor layer to form at least one donor element at the at least one defined area, the at least one donor element departing from the donor layer and depositing on the first substrate corresponding to the at least one defined area; and providing a second substrate on the at least one donor element. The at least one donor element is functioned as a light modulation unit by application of external energy such as electromagnetic rays or heat.

In yet another aspect, the present invention provides a method for thermal mass transfer forming a display device by using the present thermal transfer device, which comprises providing a first substrate with a plurality of first pixel electrodes formed thereon; providing a donor layer over the first pixel electrodes, wherein the donor layer is functioned as light modulator by application of external energy; providing thermal energy to the donor layer opposite to the first pixel electrodes such that at least one donor element formed by at least one defined area of the donor layer absorbing thermal energy, and the at least one donor element is deposited on the first pixel electrodes corresponding to the at least defined area; and forming at least one second pixel electrode on the at least one donor element corresponding to the first pixel electrodes so as to constitute at least one pixel formed as at least one light modulation unit.

DETAILED DESCRIPTION OF THE PREFERRED EMBODIMENTS

The present invention provides a thermal transfer device and a method using the same to form a light modulator or a basic display unit by thermal transfer of the material from a donor layer capable of modulating light under application of external energy to a display substrate. In the present invention, the thermal transfer device and the method using the same for thermal mass transfer forming a basic display unit or a light modulator will be described in detail according to embodiments with reference to accompanying drawings.

Figure 3:
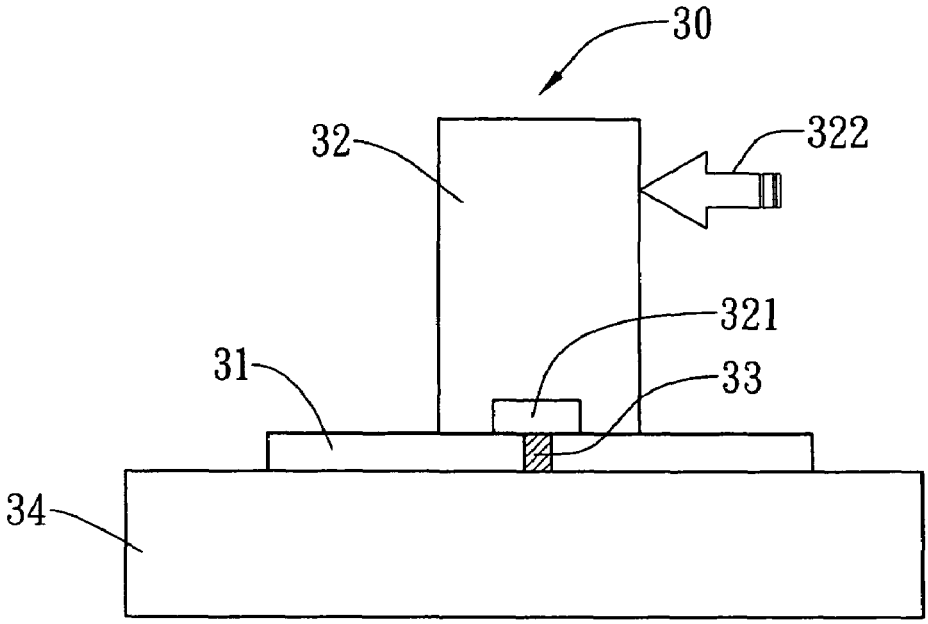
FIG. 3 is a schematic cross-sectional view of a thermal transfer device according to a first embodiment of the present invention.

FIG. 3 is a schematic cross-sectional view of the thermal transfer device in accordance with a first embodiment of the present invention. In the first embodiment of the present invention, the thermal transfer device 30 includes a donor layer 31 capable of modulating light by application of external energy, a print head 32 for conducting thermal energy to the donor layer 31, at least one donor element 33 formed by the donor layer 31 absorbing the thermal energy, and a substrate 34 receiving the at least one donor element 33 thereon. The light modulating function is well defined hereinafter by a modulating device controlled by application of external energy transfers input light into output light. The print head 32 can be designed to include a large number of heat elements 321 which are arranged in an array corresponding to a pixel pattern of a display device, and each of the heat elements 321 individually radiates an amount of heat energy depending on a drive signal 322 for a corresponding pixel. The drive signal 322 can be in a form of an optical signal or electric signal. When the drive signal 322 is the optical signal, each of the heat elements 321 of the print head 32 can further comprise a light-to-heat conversion (LTHC) element (not shown) to transfer the drive signal 322 in the form of the optical signal to heat. When the drive signal 322 is the electric signal, it can be directly transferred to heat by heater-like device and forms the heat source in corresponding heat element 321. In another way, each of the heat elements 321 can further comprise an electro-optic element (not shown) to first transfer the electric signal to an optical signal, and then the LTHC element transfer the optical signal to heat. The donor layer 31 absorbs heat energy from the heat elements 321 of the print head 32 and conducts reaction like melting to form molten donor elements 33 in defined areas of the donor layer 31 corresponding to the positions of the heat elements 321. Then, the molten donor elements 33 depart from the donor layer 31 and deposit on the substrate 31. A plurality of first pixel electrodes (not shown) can be first formed on the substrate 31, and thus the donor elements 33 are deposited on the first pixel electrodes of the substrate 31. A plurality of second pixel electrodes (not shown) is then formed on the donor elements 33. Because the donor layer 31 can modulate light by applying external energy thereto, the donor elements 33 deposited on the substrate 34 can be functioned as light modulation units under the application of the external energy such as generated by electric field. As such, the first pixel electrodes, the donor elements 33 and the second pixel electrodes can constitute pixel cells on the substrate 34. Another substrate (not shown) can be formed on the second pixel electrodes. A basic display unit or light modulator thus can be made by the present thermal transfer device 30. The first pixel electrodes and second pixel electrodes of the basic display unit can carry electric signals to generate electric field to drive the donor elements 33 performing light modulation. Besides, the first pixel electrodes and second pixel electrodes can be removed from the basic display unit, and the donor elements 33 can be driven by the external energy like electromagnetic ray or heat.

The donor layer 31 capable of modulating light by applying external energy thereto can comprise liquid crystal, encapsulated liquid crystal such as encapsulated chiral nematic liquid crystal, encapsulated electrophoretic display medium, encapsulated liquid powder display medium or encapsulated electrowetting display medium. Taking as an example, the encapsulated liquid crystal means a quantity of liquid crystal material confined or contained in the encapsulating medium. One method of making encapsulated liquid crystal includes mixing together liquid crystal material and an encapsulating medium in which the liquid crystal material will not dissolve and permitting formation of discrete capsules containing the liquid crystal material.

The deposition of the donor elements 33 over the substrate 34 can be followed by such methods of including drying or surface polymerization processes.

In addition, a partitioned structure (not shown) can be formed on the first pixel electrodes of the substrate 34 before depositing the donor elements 33 thereon, and then the donor elements 33 can be deposited on the partitions provided by the partitioned structure.

Figure 1:
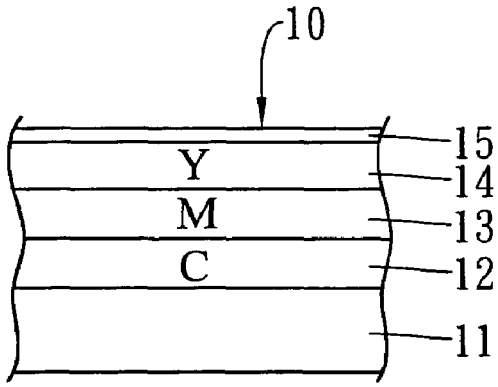
Fig. 1 (Prior Art)
FIG. 1 is a schematic cross-sectional view of a conventional thermosensitive recording medium.
Figure 2:
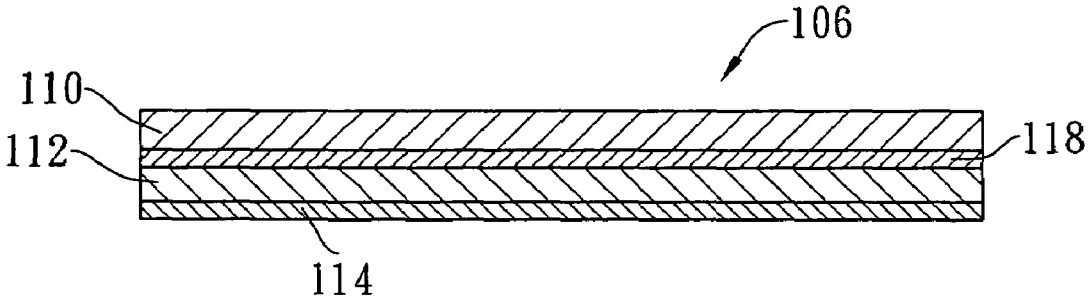
Fig. 2 (Prior Art)
FIG. 2 is a schematic cross-sectional view of a conventional thermal mass transfer donor element.
Figure 5:
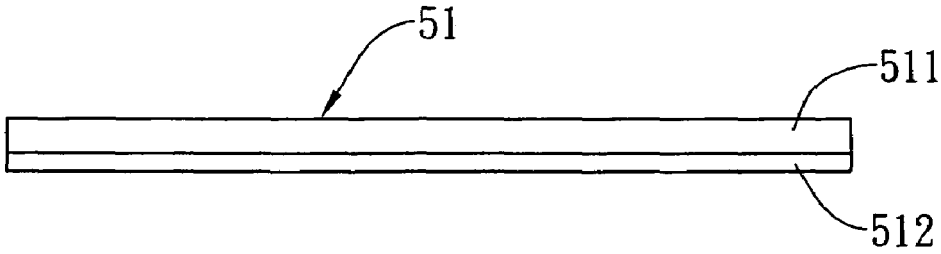
FIG. 5 is a schematic cross-sectional view of a donor medium of the present invention.

Besides, the donor layer 31 can be replaced by a donor medium 51 including a light-to-heat conversion (LTHC) layer 511 and a donor layer 512, as shown in FIG. 5. In this example, the heat elements 321 of the print head 32 does not irradiate thermal energy, instead, conducts electromagnectic rays to the donor medium 51. The heat element 321 would not need to be provided with the LTHC elements, the drive signal 322 is in the form of electric signal and transfers the electric signal to the optical signal by electro-optic element (not shown) in corresponding heat element 321. The donor layer 512 is the same with the donor layer 31.

Figure 4:
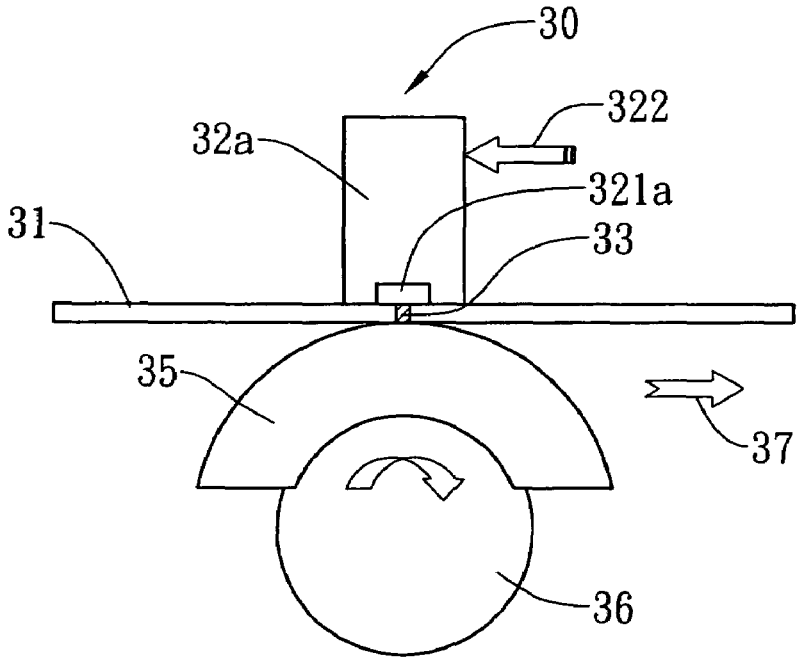
FIG. 4 is a schematic cross-sectional view of a thermal transfer device according to a second embodiment of the present invention.

FIG. 4 is a schematic cross-sectional view of the thermal transfer device according to a second embodiment of the present invention. In the second embodiment, the substrate for receiving the donor elements 33 is replaced by a roll-type substrate 35 which can be carried by a platen 36, and the print head 32*a* has a plurality of heat elements 321*a* arranged in a one-dimension array. The donor layer 31 is moved along an arrow-marked direction 37 such that the molten donor elements 33 depart from the donor layer 31 and deposit on the defined areas of the roll-type substrate 35. Except for the roll-type substrate 35, the other components of the thermal transfer device of the second embodiment are the same with the first embodiment.

While the invention has been described by way of examples and in terms of preferred embodiments, it is to be understood that those who are familiar with the subject art can carry out various modifications and similar arrangements and procedures described in the present invention and also achieve the effectiveness of the present invention. Hence, it is to be understood that the description of the present invention should be accorded with the broadest interpretation to those who are familiar with the subject art, and the invention is not limited thereto.

What is claimed is:

1. A thermal transfer device, comprising:

a donor layer capable of modulating light by application of external energy;

a print head for conducting thermal energy to said donor layer;

at least one donor element formed by said donor layer absorbing the thermal energy; and a substrate receiving said at least one donor element forming at least one light modulation unit thereon.

2. The thermal transfer device as claimed in claim 1, wherein said print head comprises a light-to-heat-conversion (LTHC) element to thermally transfer heat to said donor layer.

3. The thermal transfer device as claimed in claim 1, wherein said donor layer comprises liquid crystal, encapsulated liquid crystal, encapsulated electrophoretic display medium, encapsulated liquid powder display medium or encapsulated electrowetting display medium.

4. The thermal transfer device as claimed in claim 3, wherein said encapsulated liquid crystal comprises encapsulated chiral nematic liquid crystal.

5. The thermal transfer device as claimed in claim 1, wherein the external energy is provided by electrical field, electromagnetic rays or heat.

6. A thermal transfer device, comprising:

a donor medium comprising a donor layer capable of modulating light by application of external energy and a light-to-heat-conversion (LTHC) layer;

a print head conducting electromagnetic rays to said donor medium to convert light to thermal energy by said LTHC layer;

at least one donor element formed by said donor layer absorbing the thermal energy; and a substrate receiving said at least one donor element forming at least one light modulation unit thereon.

7. The thermal transfer device as claimed in claim 6, wherein said donor layer comprises liquid crystal, encapsulated liquid crystal, encapsulated electrophoretic display medium, encapsulated liquid powder display medium or encapsulated electrowetting display medium.

8. The thermal transfer device as claimed in claim 7, wherein said encapsulated liquid crystal comprises encapsulated chiral nematic liquid crystal.

9. The thermal transfer device as claimed in claim 6, wherein the external energy is provided by electrical field, electromagnetic rays or heat.

10. A method for thermal mass transfer forming a display device, comprising:

providing a first substrate with a plurality of first pixel electrodes formed thereon;

providing a donor layer over said first pixel electrodes, wherein said donor layer is functioned as light modulator by application of external energy;

providing thermal energy to said donor layer opposite to said first pixel electrodes such that at least one donor element formed by at least one defined area of said donor layer absorbing thermal energy, and said at least one donor element is deposited on said first pixel electrodes corresponding to said at least defined area; and forming at least one second pixel electrode on said at least one donor element corresponding to said first pixel electrodes so as to constitute at least one pixel formed as at least one light modulation unit.

11. The method as claimed in claim 10, wherein forming a second substrate on said at least one second pixel electrode.

12. The method as claimed in claim 11, wherein said donor layer comprises liquid crystal, encapsulated liquid crystal, encapsulated electrophoretic display medium, encapsulated liquid powder display medium or encapsulated electrowetting display medium.

13. The method as claimed in claim 12, wherein said donor layer comprises encapsulated chiral nematic liquid crystal.

14. The method as claimed in claim 10, wherein the deposition comprises drying process.

15. The method as claimed, in claim 10, wherein the deposition comprises surface polymerization process.

16. The method as claimed in claim 10, wherein comprises forming a partitioned structure on said first pixel electrodes.

17. The method as claimed in claim 16, wherein said at least one donor element is deposited in one partition of said partitioned structure.

18. A method for thermal mass transfer forming a display device, comprising:

providing a donor layer over a first substrate;

providing thermal energy to at least one defined area of said donor layer to form at least one donor element at said at least one defined area, said at least one donor element departing from said donor layer and depositing on said first substrate corresponding to said at least one defined area; and providing a second substrate on said at least one donor element;

wherein said at least one donor element is functioned as a light modulation unit by application of external energy.

19. The method as claimed in claim 18, wherein comprises forming a partitioned structure on said first substrate. to receive said at least one donor element in one partition of said partitioned structure.

20. The method as claimed in claim 18, wherein the external energy is heat or electromagnetic rays.

* * * * *